US007175451B2

(12) United States Patent
Shuey

(10) Patent No.: US 7,175,451 B2
(45) Date of Patent: Feb. 13, 2007

(54) LEVER MATED CONNECTOR ASSEMBLY WITH A POSITION ASSURANCE DEVICE

(75) Inventor: John R Shuey, Mechanicsburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 29 days.

(21) Appl. No.: 11/080,736

(22) Filed: Mar. 15, 2005

(65) Prior Publication Data

US 2006/0211286 A1 Sep. 21, 2006

(51) Int. Cl.
*H01R 13/62* (2006.01)

(52) U.S. Cl. ..... 439/157; 439/352

(58) Field of Classification Search ..... 439/157–160, 439/352, 595

See application file for complete search history.

(56) References Cited

U.S. PATENT DOCUMENTS 4,370,013 A * 1/1983 Niitsu et al. ..... 439/352
6,824,406 B1 * 11/2004 Sharples et al. ..... 439/157
2003/0109155 A1 6/2003 Kazunori
2003/0190836 A1 10/2003 Kazunori
2004/0192090 A1 * 9/2004 Flowers et al. ..... 439/157
2006/0040535 A1 * 2/2006 Koshy et al. ..... 439/157

FOREIGN PATENT DOCUMENTS

| | | |
|---|---|---|
| DE | 103 32 894 | 2/2005 |
| EP | 1 047 155 | 10/2000 |
| EP | 1 093 191 | 4/2001 |
| WO | WO 2004/093258 | 10/2004 |

* cited by examiner

*Primary Examiner*—Briggitte R. Hammond

(57) ABSTRACT

A lever mated connector assembly including a housing configured to mate with a header, a wire guide mounted to the housing having a latch with a retaining surface, a lever having a catch with a retaining surface and being coupled to the housing for rotational movement between an unlocked position and a locked position wherein the catch retaining surface engages the latch retaining surface to inhibit movement of the lever out of the locked position, and a connector position assurance ("CPA") device having a locking surface and being mounted to the wire guide for movement between a first position and a second position wherein the locking surface inhibits movement of the latch, thereby further inhibiting movement of the lever out of the locked position.

29 Claims, 12 Drawing Sheets

LEVER MATED CONNECTOR ASSEMBLY WITH A POSITION ASSURANCE DEVICE

FIELD OF THE INVENTION

The present invention generally relates to connectors, and more particularly to a lever mated connector assembly having a connector position assurance ("CPA") device for preventing movement of the connector assembly lever out of a locked position.

BACKGROUND OF THE INVENTION

In certain applications, electrical connectors must be securely mated to one another to prevent disconnection of the electrical signals routed through the connector conductors. For example, in automotive applications wherein electrical signals are routed to safety equipment such as air bag deployment systems or other systems relating to the operational or safety features of the vehicle, disconnection of the electrical signals as a result of accident, negligence, or operating conditions such as vibration, etc. may result in undesirable consequences. Thus, some electrical connectors are coupled to connector assemblies that mechanically lock the electrical connectors in mating engagement with one another.

Some conventional connector assemblies include a housing that houses an electrical connector, a wire guide attached to the housing and enclosing the electrical connector, and a lever that couples the housing to a header housing a mating electrical connector. When in a locked position, the lever prevents disconnection of the housing from the header, which prevents disconnection of the mated electrical connectors. Some levers are further configured to latch into engagement with the wire guide when the lever is in the locked position to ensure that the lever is not unintentionally moved out of the locked position. If sufficient force is applied to such levers, however, they may disengage from the wire guide and permit disconnection of the mated electrical connectors.

SUMMARY OF THE INVENTION

The present invention provides a lever mated connector assembly that includes a CPA device for preventing unintentional movement of the lever from its locked position, even if substantial force is applied to the lever. In one embodiment, the connector assembly includes a housing configured to mate with a header and house an electrical connector that mates with an electrical connector housed by the header. The connector assembly further includes a wire guide mounted to the housing that includes a latch with a retaining surface, and a lever with a catch having a retaining surface that engages the latch retaining surface to inhibit movement of the lever out of a locked position. Additionally, the connector assembly includes a CPA device having a locking surface. The CPA device is mounted to the wire guide for movement between a first position and a second position wherein the locking surface inhibits movement of the latch, thereby further inhibiting movement of the lever out of the locked position.

The above mentioned and other features of this invention, and the manner of attaining them, will become more apparent and the invention itself will be better understood by reference to the following description of embodiments of the invention taken in conjunction with the accompanying drawings.

Figure 1:
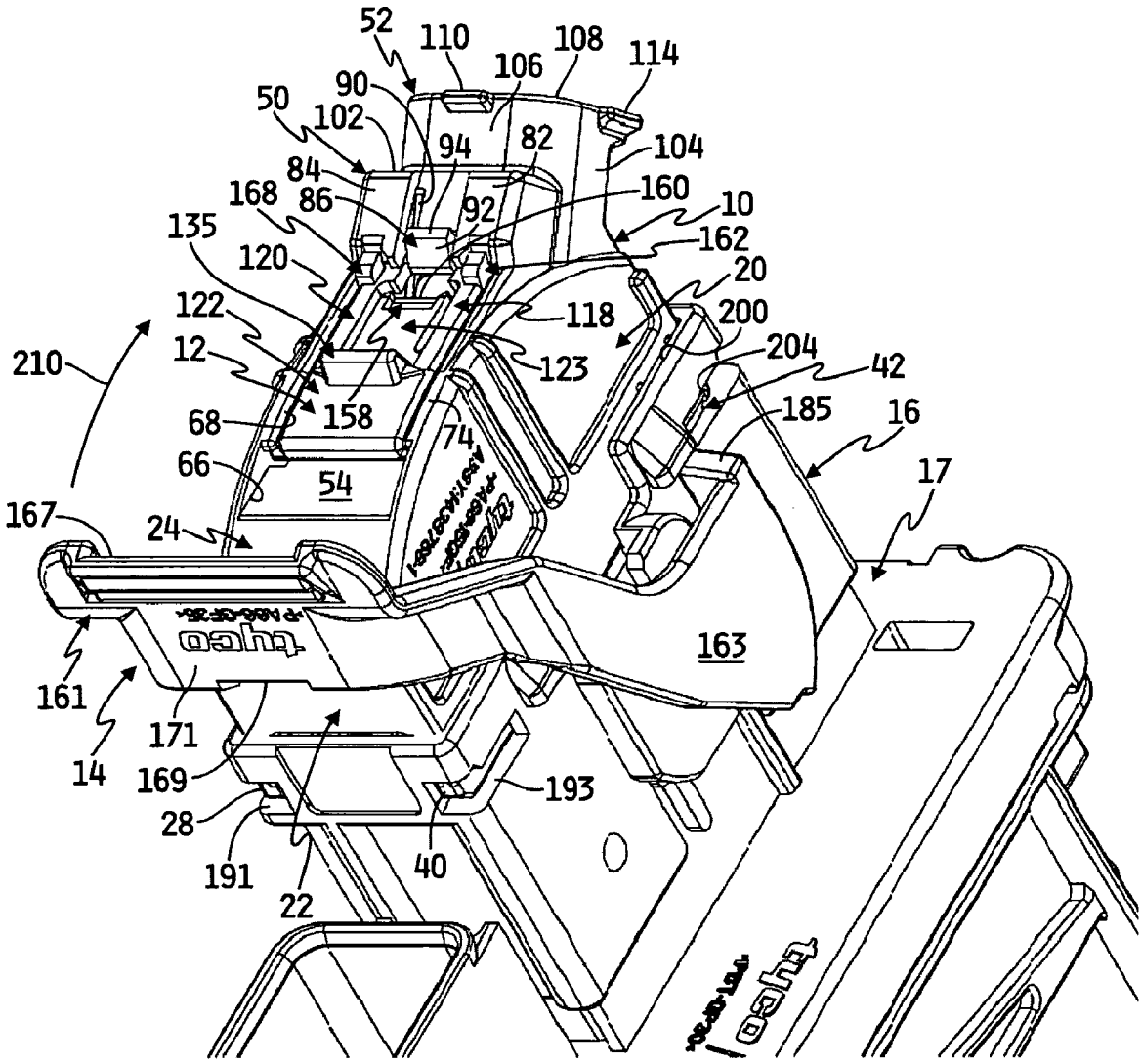
FIG. 1 is a perspective view of one embodiment of a lever mated connector assembly according to the present invention depicting the lever in an unlocked position.
Figure 2:
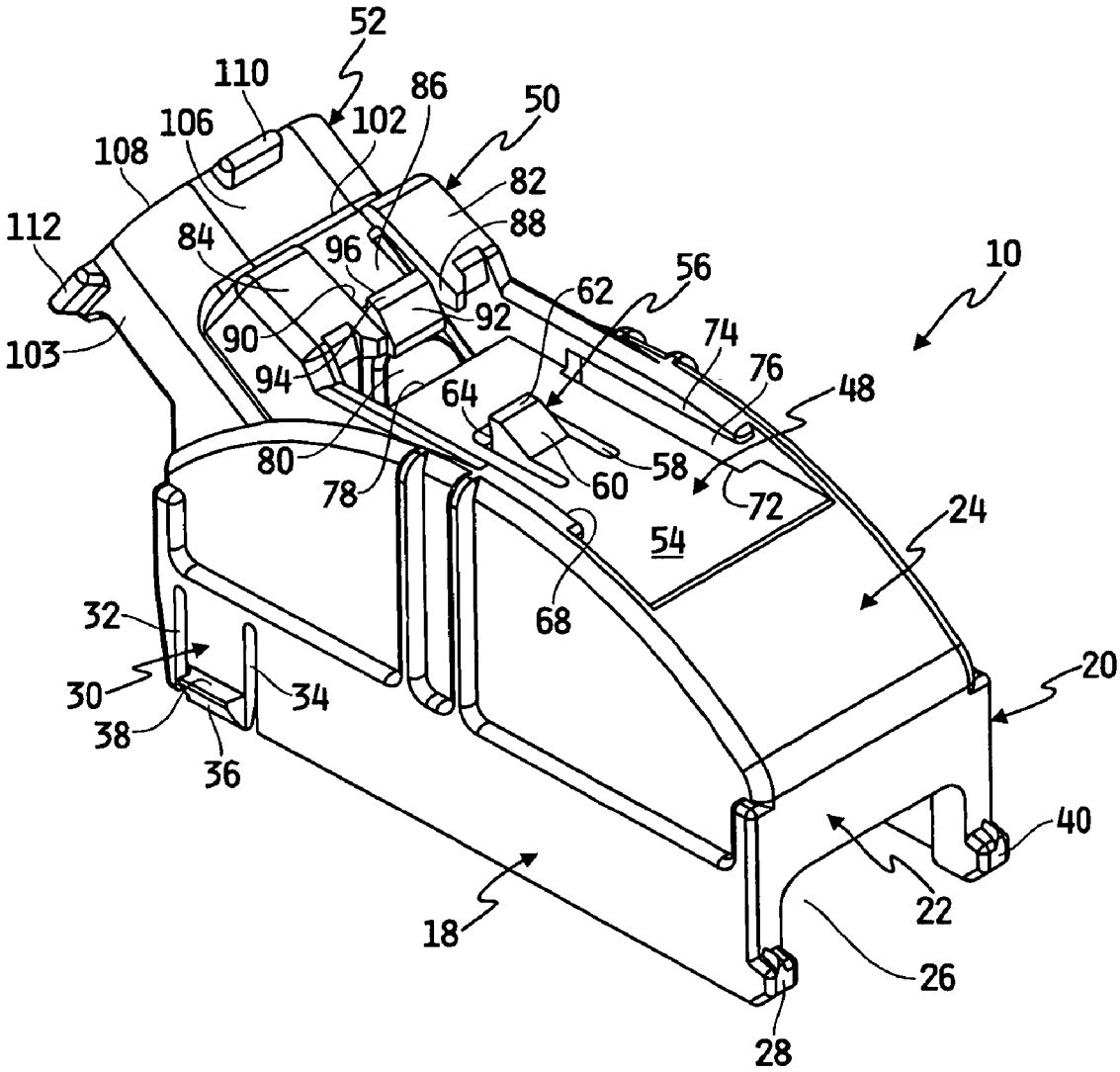
FIGS. 2 and 3 are perspective views of a wire guide of the lever mated connector assembly of FIG. 1.
Figure 3:
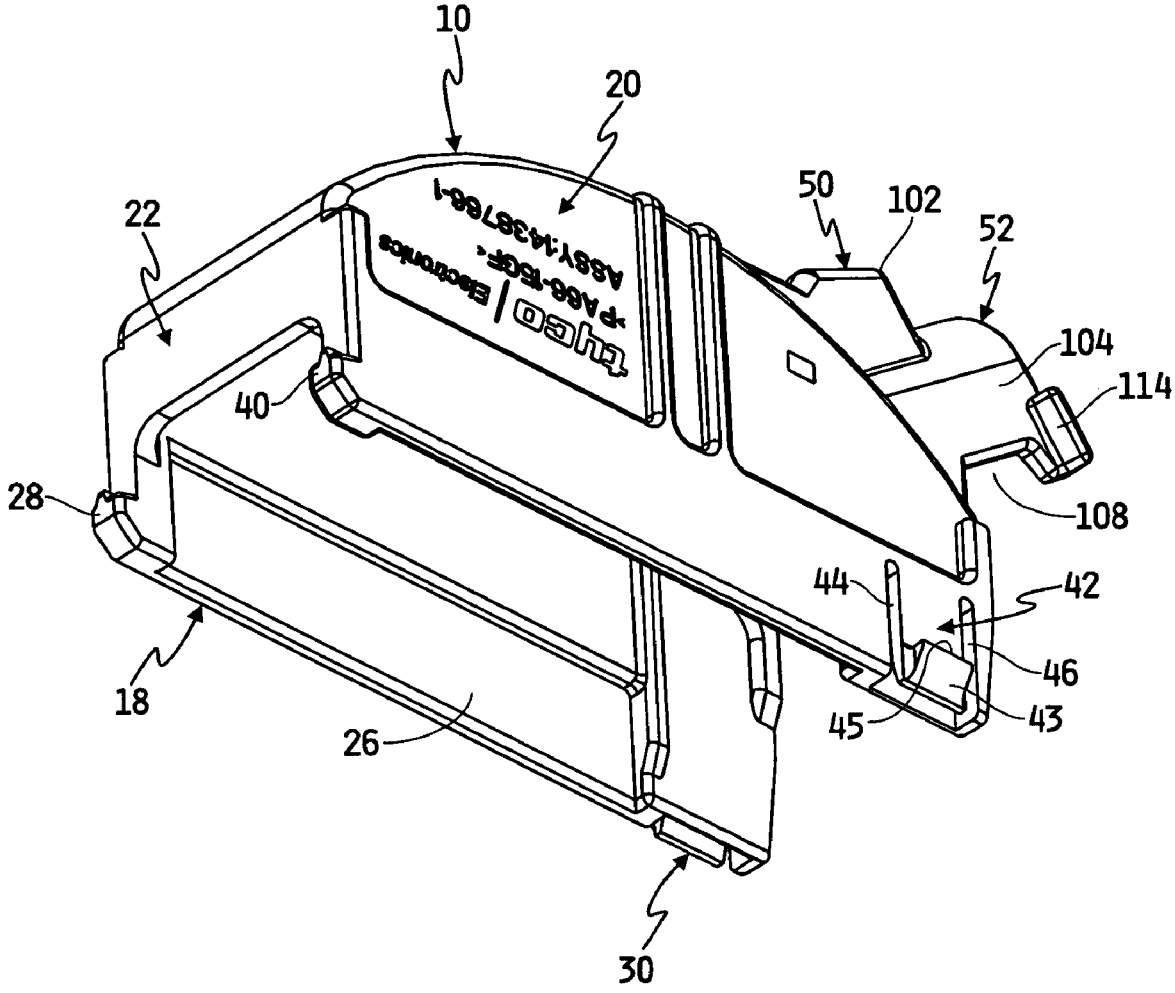

Corresponding reference characters indicate corresponding parts throughout the several views. Although the drawings represent embodiments of the present invention, the drawings are not necessarily to scale and certain features may be exaggerated in order to better illustrate and explain the present invention.

DETAILED DESCRIPTION OF EMBODIMENTS OF THE INVENTION

The embodiments disclosed below are not intended to be exhaustive or to limit the invention to the precise forms disclosed in the following detailed description. Rather, the embodiments are chosen and described so that others skilled in the art may utilize their teachings.

Referring now to FIG. 1, one embodiment of a lever mated connector assembly to the present invention having a position assurance device configured for mating with a lever is shown. It should be understood that the connector assembly described herein may be suitable for many applications wherein secure mating between electrical contacts is desirable, such as for vehicle airbag applications. In general, the connector assembly includes a wire guide 10, a CPA device 12 coupled to wire guide 10, and a lever 14 coupled to a housing 16 and configured for cooperation with wire guide 10 and CPA device 12. As is further described below, wire guide 10 mates with housing 16, and lever 14 is used to mate the connector assembly with a header 17.

Referring now to FIGS. 1 through 4B, wire guide 10 generally includes a pair of side walls 18, 20, a rear wall 22, and an upper wall 24, together forming an interior space 26. Side wall 18 includes a rear protrusion 28 and a tab 30 defined on side wall 18 by a pair of notches 32, 34 that permit tab 30 to deflect slightly inwardly toward interior space 26 upon mating of wire guide 10 with housing 16 as is further described below. Tab 30 includes a cam surface 36 and a shoulder 38 for engaging housing 16. Side wall 20 similarly includes a rear protrusion 40 and a tab 42 defined by a pair of notches 44, 46 and including a cam surface 43 and a shoulder 45.

Upper wall 24 generally includes a CPA device receiving portion 48, a lever retaining portion 50, and a wire shroud 52. CPA device receiving portion 48 includes a substantially flat wall 54 including a retaining wedge 56 defined by a cut-out 58. Wedge 56 includes a cam surface 60, an upper surface 62, and a retaining surface 64, and flexibly extends from wall 54 such that pressure on cam surface 60 causes wedge 56 to flex inwardly toward interior space 26. One edge 66 (FIG. 4A) of wall 54 cooperates with side wall 18 and a ridge 68 extending inwardly from side wall 18 toward side wall 20 to form a channel 70 for receiving CPA device 12 as is further described below. Similarly, an opposite edge 72 (FIGS. 2 and 4A) of wall 54 cooperates with side wall 20 and a ridge 74 extending inwardly from side wall 20 toward side wall 18 to form a channel 76 for receiving CPA device 12. A distal edge 78 of wall 54 forms an opening 80 with side walls 18, 20 and lever retaining portion 50 for receiving a portion of CPA device 12 as is further described below.

Figure 4A:
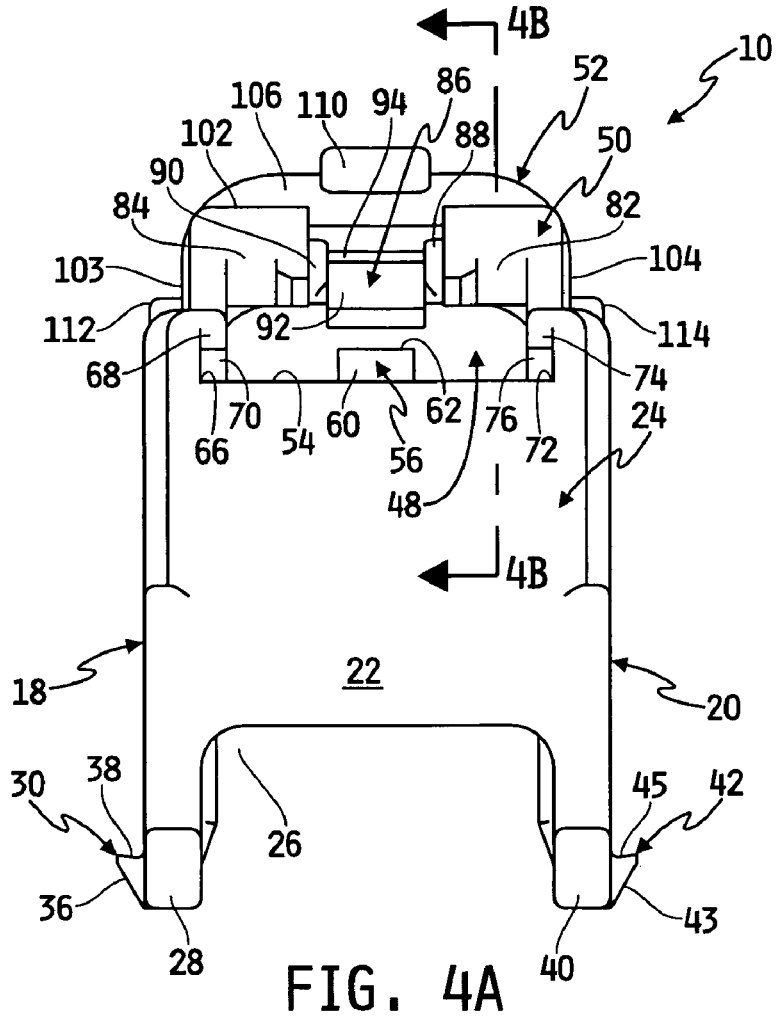
FIG. 4A is a rear elevation view of the wire guide of FIGS. 2 and 3.
Figure 4B:
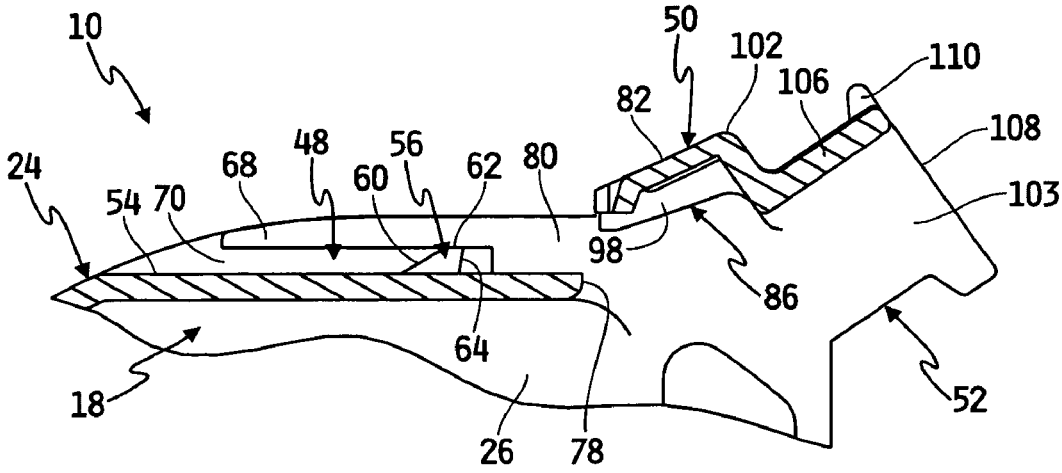
FIG. 4B is a partially fragmented, cross-sectional view taken substantially along line 4B—4B of FIG. 4A.

Lever retaining portion 50 includes a pair of flats 82, 84 and a cantilever latch 86 positioned between flats 82, 84 and defined by a pair of cut-outs 88, 90. Latch 86 includes a cam surface 92, an upper surface 94, and a retaining surface 96. A pair of recesses 98, 100 (only recess 98 is shown in FIG. 4B) are formed in lever retaining portion 50 to receive retaining wedges extending from CPA device 12 as is further described below. A distal edge 102 of lever retaining portion 50 transitions to wire shroud 52.

Wire shroud 52 includes a pair of side walls 103, 104 and an upper wall 106, which together form an opening 108 for receiving wires (not shown). A tab 110 is formed on upper wall 106, and similar tabs 112, 114 are formed on wire shroud side walls 102, 104, respectively, to permit the user to attach a cable tie or wire clamp.

Figure 5:
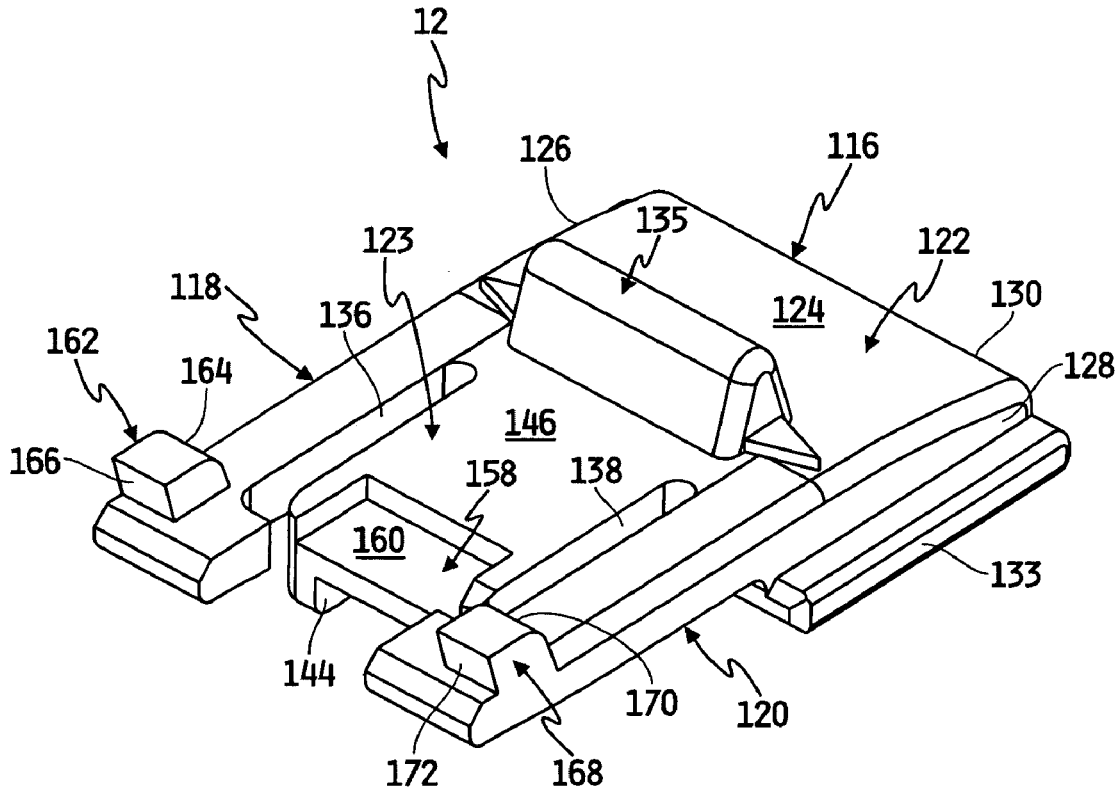
FIGS. 5 and 6 are perspective views of a CPA device of the lever mated connector assembly of FIG. 1.
Figure 6:
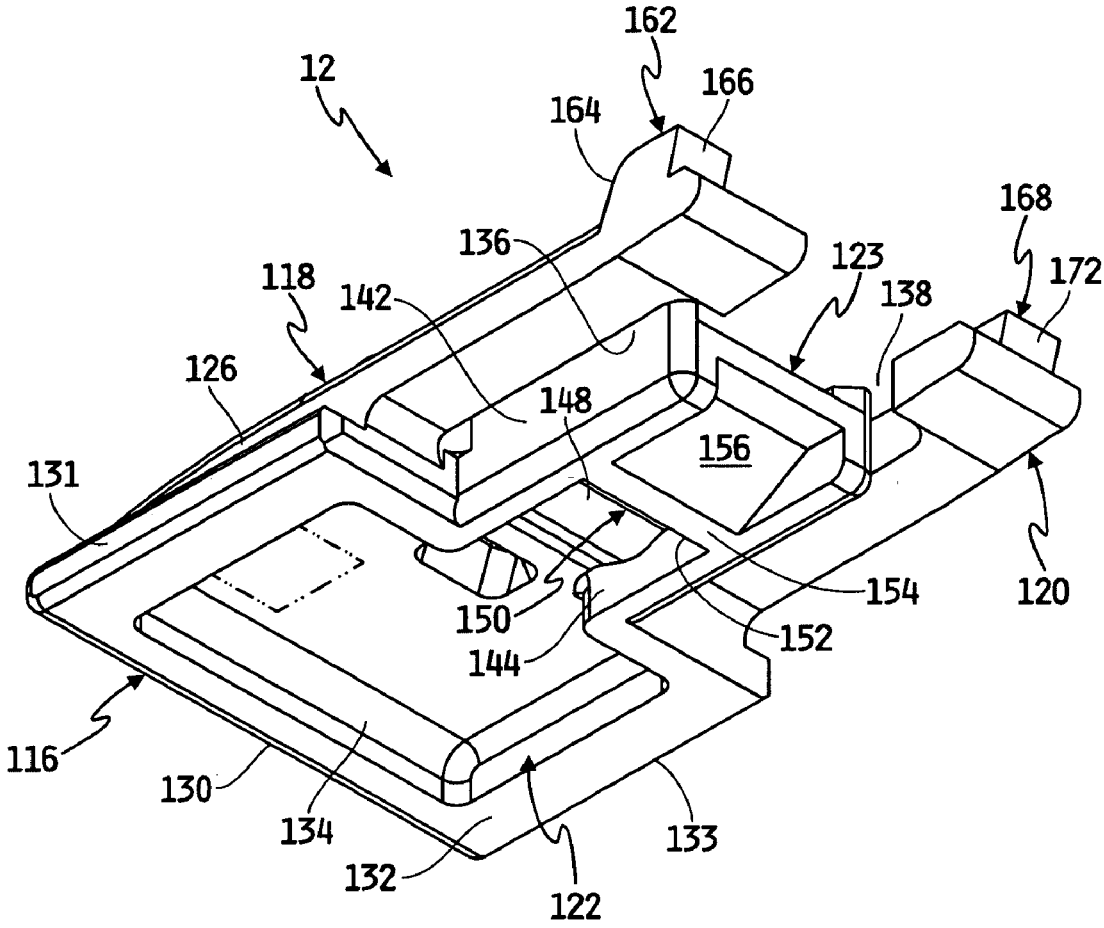
Figure 7:
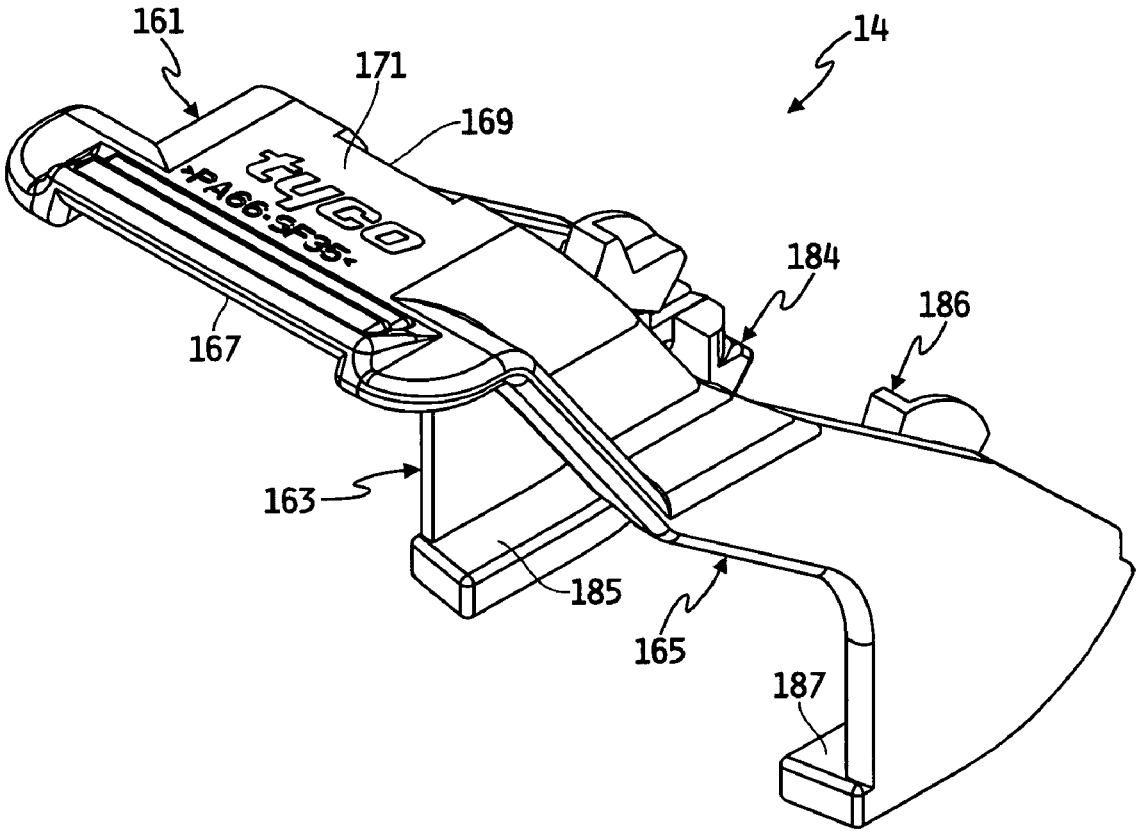
FIGS. 7 and 8 are perspective views of a lever of the lever mated connector assembly of FIG. 1.
Figure 8:
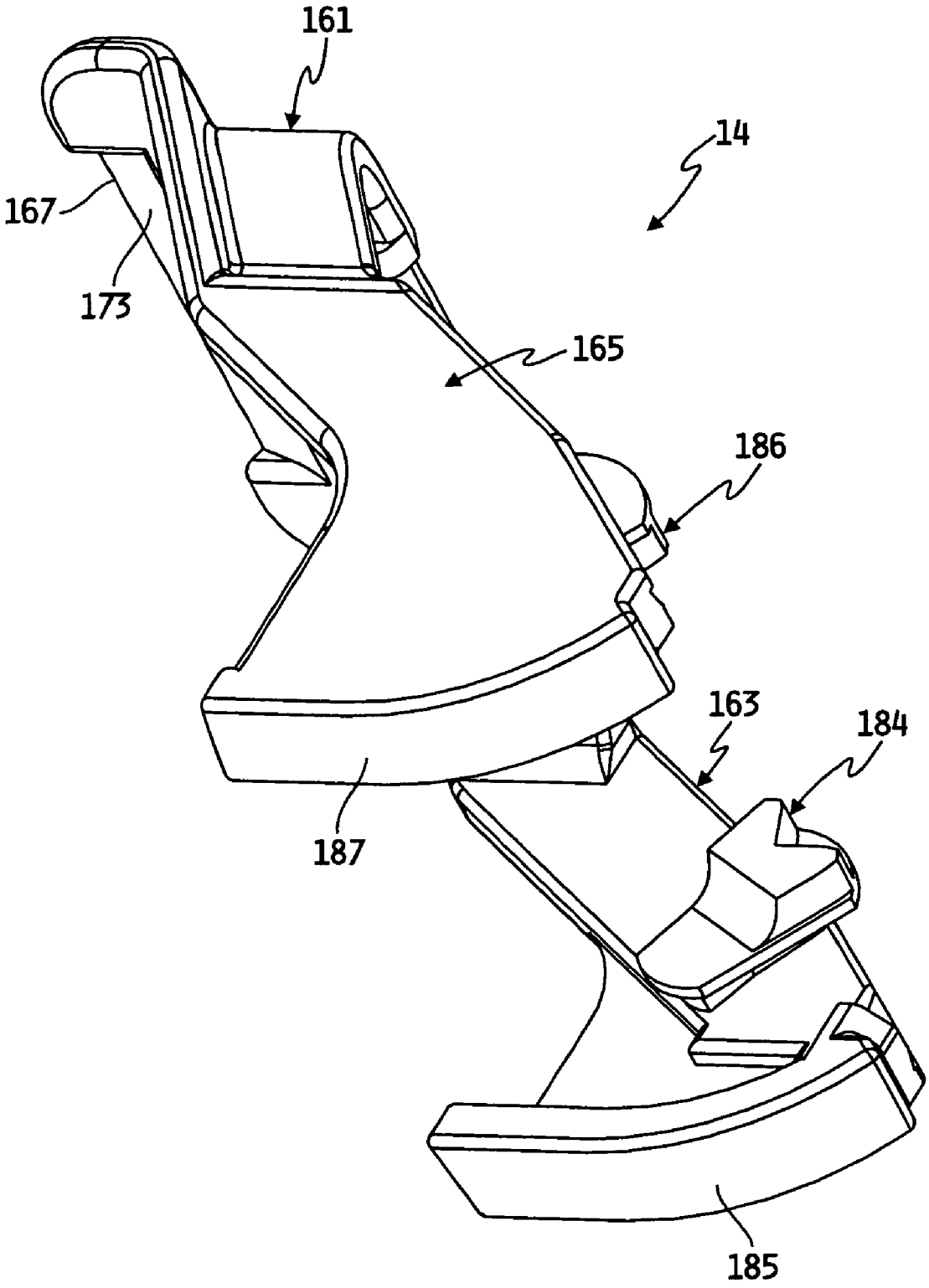
Figure 9A:
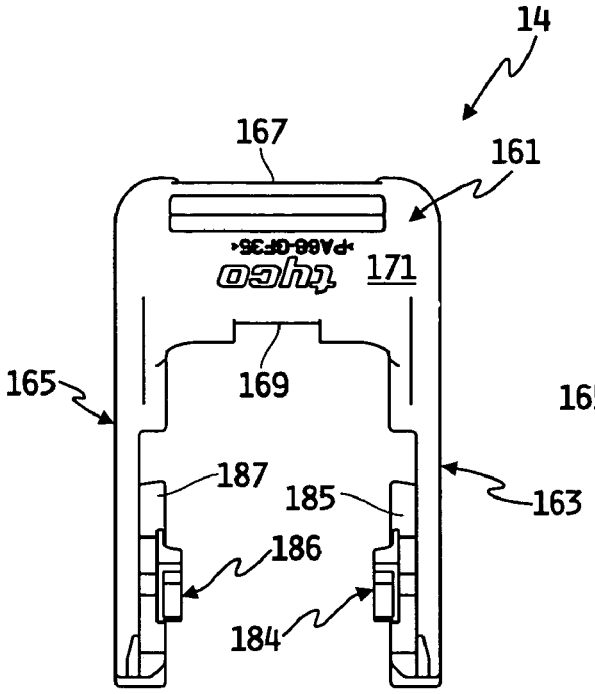
FIG. 9A is a top plan view of the lever of FIGS. 7 and 8.
Figure 9B:
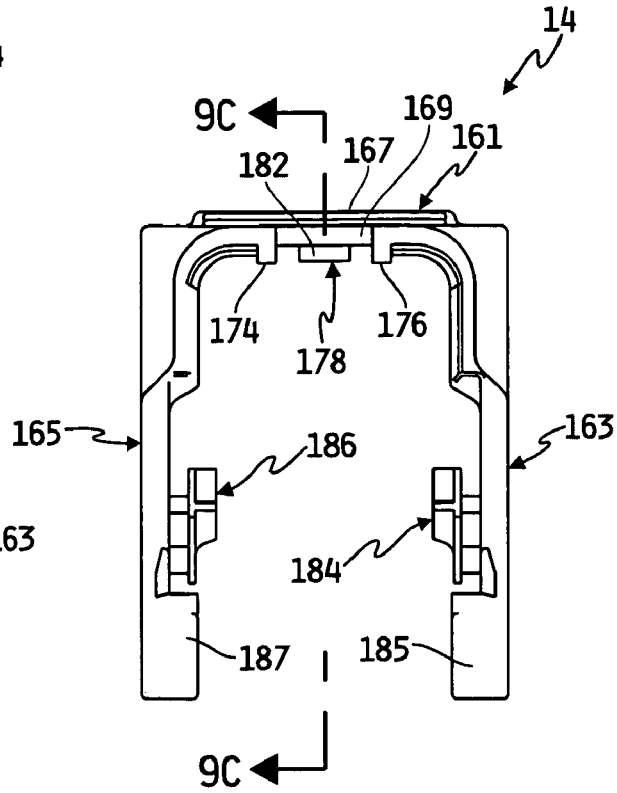
FIG. 9B is a rear elevation view of the lever of FIGS. 7 and 8.
Figure 9C:
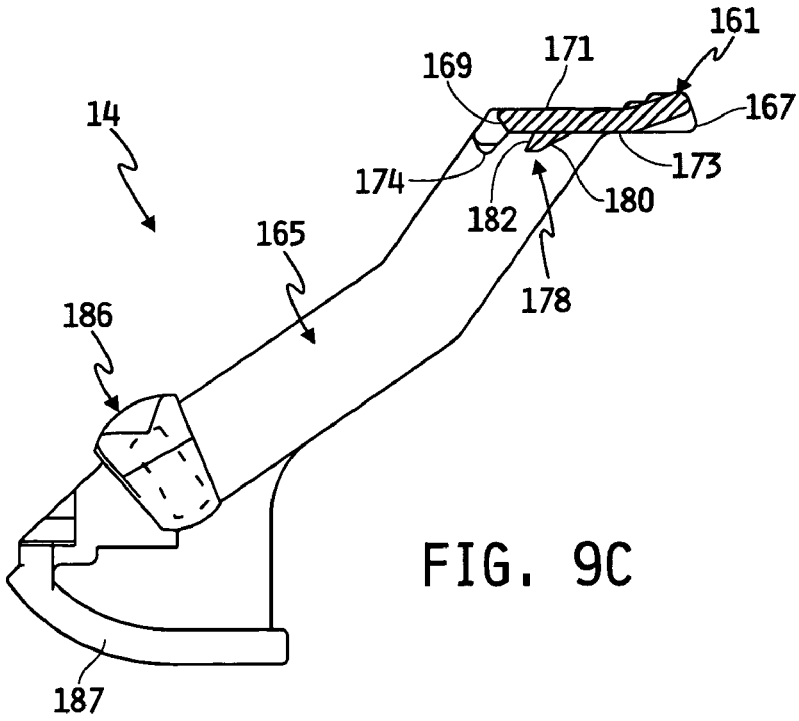
FIG. 9C is a cross-sectional view taken substantially along line 9C—9C of FIG. 8.

Referring now to FIGS. 1, 5 and 6, CPA device 12 generally includes a body 116 having a pair of arms 118, 120. Body 116 includes a base portion 122 and an extension 123. Base portion 122 includes an upper wall 124, a pair of side walls 126, 128, a rear wall 130, and a lower wall 132, which together define an interior space 134. Lower wall 132 extends laterally from side walls 126, 128 to form rails 131, 133 which are respectively received by channels 70, 68 (FIG. 4B) of CPA device receiving portion 48 as is further described below. Upper wall 124 includes a push ridge 135 that projects upwardly relative to interior space 134 and is configured to permit a user to move CPA device 12 between a locked position and an unlocked position as is further described below.

As should be apparent from the drawings, extension 123 of body 116 is substantially separated from arms 118, 120 by a pair of cut-outs 136, 138. As such, arms 118, 120 may flex slightly relative to body 116. Extension 123 includes a pair of side walls 142, 144, an upper surface 146, and a lower surface 148. Extending between side walls 142, 144 of extension 123 adjacent lower surface 148 is a retaining wall 150 including a retaining surface 152, a transition surface 154, and a cam surface 156. As best shown in FIG. 5, opposite cam surface 156 of lower surface 148 is a recess 158 having a locking surface 160 formed on upper surface 146 of extension 123. As is further described below, locking surface 160 cooperates with lever retaining portion 50 to prevent movement of lever 14 out of its locked position.

Arm 118 of CPA device 12 includes a retaining wedge 162 having a cam surface 164 and a forward surface 166. Similarly, arm 120 includes a retaining wedge 168 having a cam surface 170 and a forward surface 172.

Referring now to FIGS. 1, 7, 8 and 9A–C, lever 14 generally includes a handle 161 and a pair of support arms 163, 165 extending substantially perpendicularly from handle 161. Handle 161 includes a forward edge 167, a rearward edge 169, an upper surface 171, and a lower surface 173. A pair of cams 174, 176 extend downwardly from lower surface 173 to engage and deflect CPA device arms 120, 118, respectively, when lever 14 is in its locked position as is further described below. Lower surface 173 further includes a catch 178 having a cam surface 180 (FIG. 9C) and a retaining surface 182 for cooperating with retaining surface 96 of cantilever latch 86 to retain lever 14 in its locked position as is further described below. Support arm 163 of lever 14 includes an inwardly projecting lug 184 that is received by a recess (not shown) formed in housing 16. Support arm 165 also includes an inwardly projecting lug 186 that is received by a recess (not shown) formed in housing 16. Lugs 184, 186 oppose one another and are movably received by their respective recesses, thereby permitting rotational movement of latch 14 between the unlocked position of FIG. 1 and the locked position of FIGS. 10 through 12.

Support arm 163 further includes a curved gear 185, and support arm 163 includes a similar, opposed gear 187. As is further described below, gears 185, 187 engage corresponding grooves (not shown) formed in header 17 to draw the connector assembly (i.e., wire guide 10, CPA device 12, lever 14, and housing 16) toward header 17 to provide the high mating force needed to facilitate electrical connection between a connector component disposed in housing 16 and a mating connector component disposed in header 17.

During assembly, the user installs contacts in an electrical connector 189 (FIG. 12) fitted in housing 16. After connector 189 is wired, the user installs wire guide 10 onto housing 16. More specifically, rear protrusions 28, 40 of wire guide side walls 18, 20 are positioned within corresponding openings 191, 193 formed in housing 16 and wire guide 10 is pivoted downwardly toward housing 16. Cam surfaces 36, 43 of wire guide tabs 30, 42, respectively engage upper edges 188, 200 of housing 16, thereby causing tabs 30, 42 to flex inwardly toward one another. As wire guide 10 is pivoted to its mated position, tabs 30, 42 register with openings 202, 204 formed in housing 16 and flex outwardly into the openings. Shoulders 38, 45 of tabs 30, 42 engage respective upper edges 206, 208 (not shown) of housing openings 202, 204 to prevent wire guide 10 from being pivoted out of its mated position. As should be apparent from the foregoing, a user may apply inward pressure to tabs 30, 42 to cause tabs 30, 42 to flex inwardly such that shoulders 38, 45 clear upper edges 206, 208, thereby permitting wire guide 10 to be pivoted out of its mated position. During installation of wire guide 10, the wires connected to electrical connector 189 are routed out of wire guide 10 through opening 108 of wire shroud 52.

Lever 14 is installed by flexing support arms 162, 164 slightly away from one another and positioning lugs 184, 186 into respective recesses (not shown) formed in housing 16. When support arms 162, 164 are released, lugs 184, 186 move into the recesses of housing 16 and gears 185, 187 of support arms 162, 164 mate with corresponding grooves (not shown) formed in header 17.

CPA device 12 may be fitted onto wire guide 10 before wire guide 10 is mated with housing 16 or after. In either case, CPA device 12 is slid into CPA device receiving portion 48 of wire guide 10. More specifically, base portion 122 of CPA device 12 is slid over flat wall 54 of CPA device receiving portion 48 such that rails 131, 133 of lower wall 132 move into respective channels 70, 76 of CPA device receiving port ion 48 and arms 118, 120 of CPA device 12 move toward opening 80 of wire guide 10.

As the user applies pressure to push ridge 135 to move CPA device 12 farther into CPA device receiving portion 48, cam surface 156 of retaining wall 150 engages retaining wedge 56 of flat wall 54, causing retaining wedge 56 to flex downwardly. After retaining wall 150 moves over retaining wedge 56, retaining wedge 56 returns to its initial position and is disposed partially within interior space 134 of CPA body 116. As such, retaining surface 64 of wedge 56 prevents reverse movement of CPA device 12 beyond the position wherein retaining surface 152 of retaining wall 150 engages retaining surface 64. When in this first, unlocked position (shown in FIGS. 1 and 10), retaining wedges 162, 168 formed at the ends of CPA device arms 118, 120 engage lever retaining portion 50 of wire guide 10. In particular, forward surfaces 166, 172 of retaining wedges 162, 168 engage the lower edges of flats 82, 84, thereby preventing further forward movement of CPA device 12 into opening 80.

Finally, the connector assembly is fitted onto header 17. More specifically, housing 16 is placed over header 17 such that electrical connector 189 is in alignment with a mating connector disposed within header 17, but firm electrical connection between the connector components is not yet established. This configuration is shown in FIG. 1. Next, the user applies pressure to handle 161 of lever 14 to pivot lever 14 in the direction of arrow 210 of FIG. 1 out of its unlocked position. This movement of lever 14 causes support arms 163, 165 to pivot about lugs 184, 18 6 within the recesses (not shown) formed in housing 16. The pivotal movement of lever 14 further causes gears 185, 18 7 of support arms 163, 165 to move within corresponding grooves (not shown) formed in header 17. As gears 185, 187 move within the grooves, lever 14 draws housing 16 (and wire guide 10) toward header 17, thereby causing electrical connector 189 in housing 16 to securely mate with the connector disposed in header 17.

Figure 10:
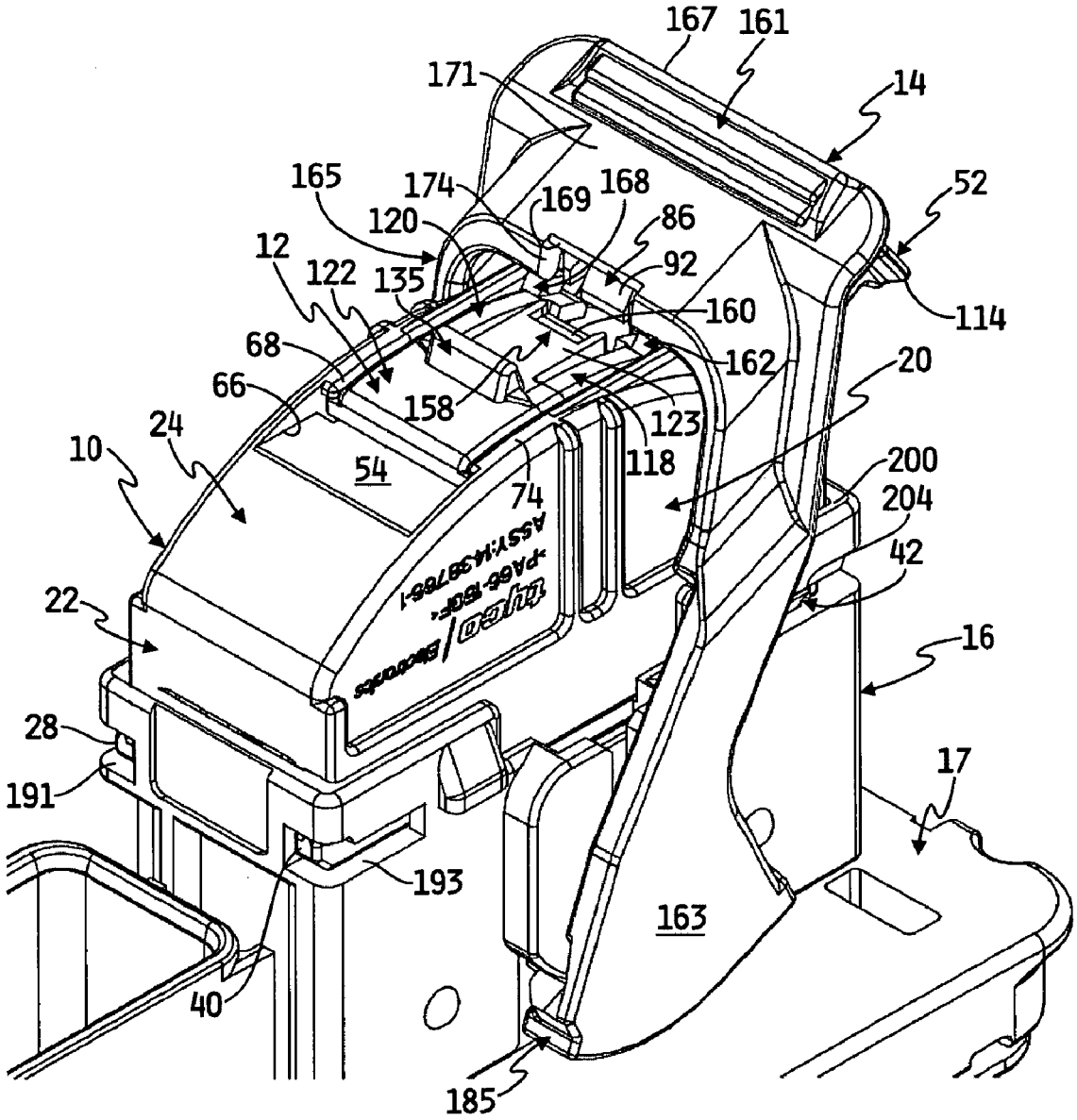
FIG. 10 is a perspective view of a lever mated connector assembly according to the present invention, depicting the lever in a locked position.

As lever 14 approaches its locked position as shown in FIG. 10, cam surface 180 of catch 178 (FIGS. 9B and 9C) engages cam surface 92 of cantilever latch 86 (FIG. 2) formed on lever retaining portion 50 of wire guide 10. As lever 14 is rotated farther, catch 178 causes cantilever latch 86 to deflect downwardly toward interior space 26 as catch 178 passes over cantilever latch 86. When lever 14 reaches its locked position and catch 178 has passed completely over cantilever latch 86, cantilever latch 86 returns to its initial position. As such, lever 14 is inhibited from being moved out of its locked position because reverse rotation of lever 14 causes retaining surface 182 of catch 178 to engage retaining surface 96 of cantilever latch 86. This constitutes a first mechanical lock of lever 14 in its locked position.

Also, when lever 14 is in its locked position, cams 174, 176 of lever 14 engage cam surfaces 164, 170 of retaining wedges 162, 168 formed at the ends of CPA device arms 118, 120, respectively. This engagement causes arms 118, 120 to flex downwardly, such that forward surfaces 166, 172 of retaining wedges 162, 168 clear the lower edges of flats 82, 84 of lever retaining portion 50. As such, CPA device 12 may be moved farther forward into opening 80 as described below.

Figure 11:
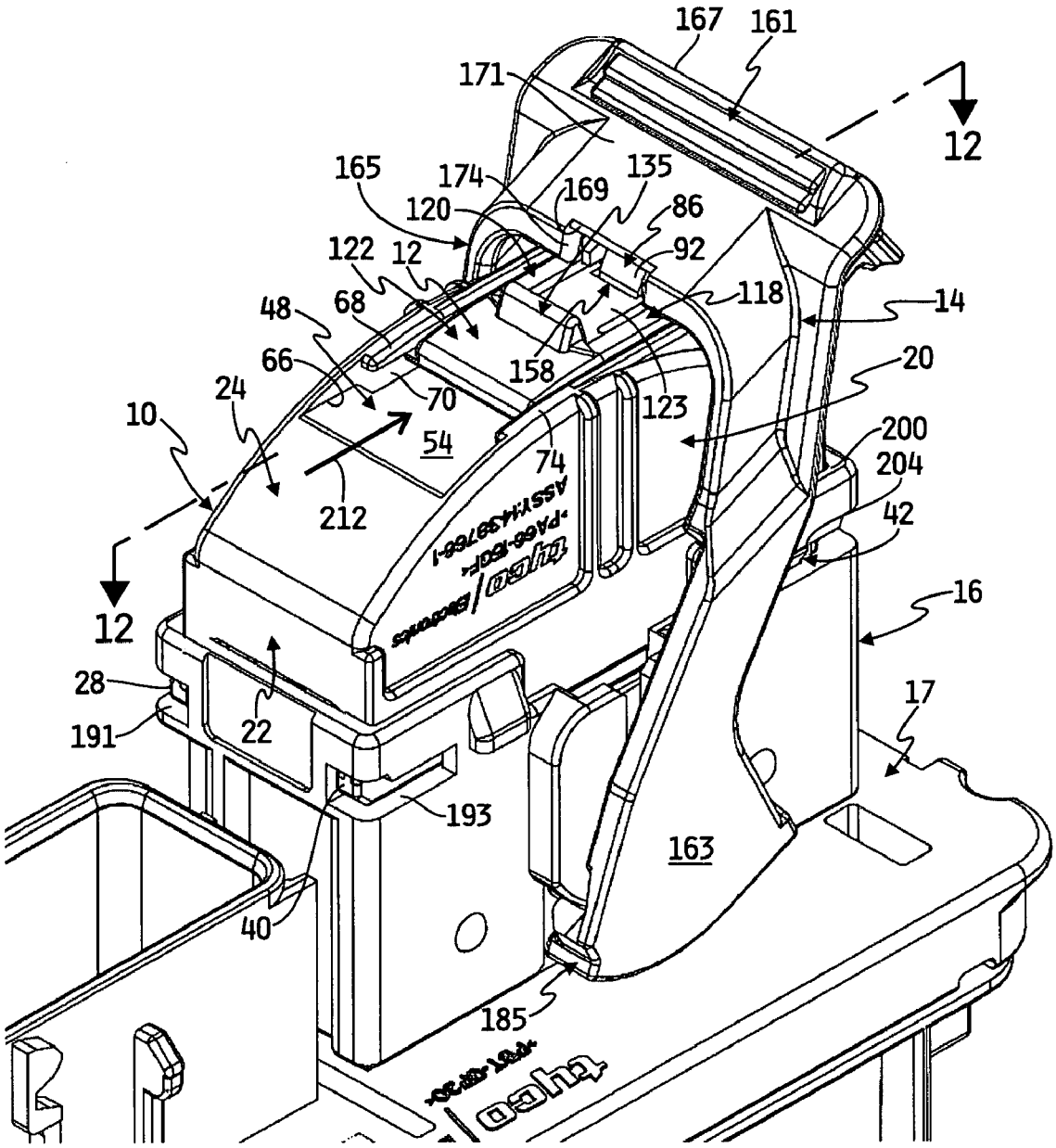
FIG. 11 is a perspective view similar to FIG. 10, depicting the CPA device in a locked position.
Figure 12:
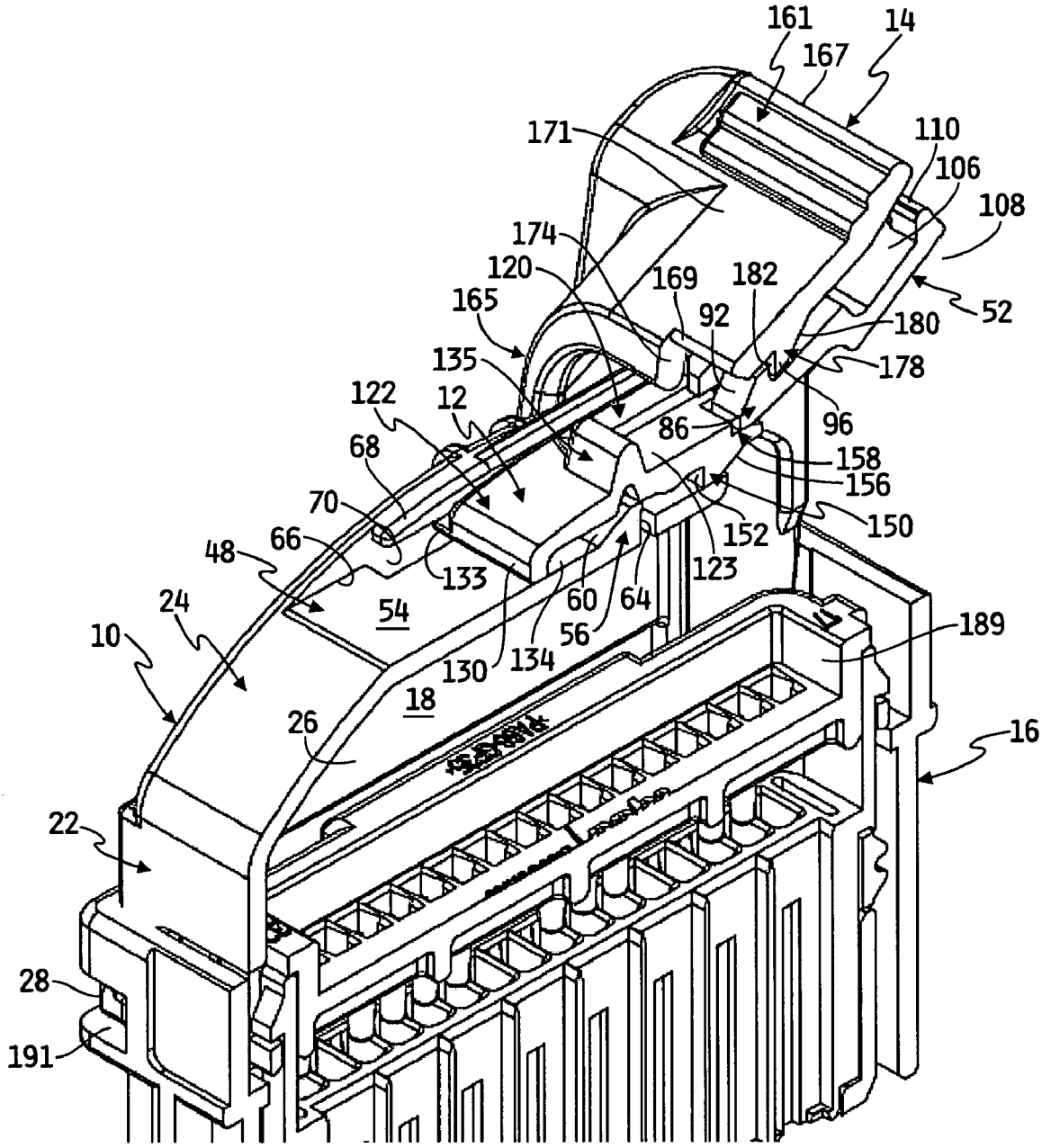
FIG. 12 is a cross-sectional view taken substantially along line 12—12 of FIG. 11.

To place CPA device 14 into its second, locked position, the user applies pressure to push ridge 135 and moves CPA device 14 farther into opening 80 in the direction of arrow 212 shown in FIG. 11. As best shown in FIGS. 5 and 12, when CPA device 14 reaches its locked position, recess 158 of CPA device extension 123 receives a portion of cantilever latch 86. As such, locking surface 160 of recess 158 prevents downward deflection of cantilever latch 86, thereby inhibiting lever 14 from being moved out of its locked position. This constitutes a second mechanical lock of lever 14 in its locked position.

Additionally, movement of CPA device 14 into its locked position causes retaining wedges 162, 168 of CPA device arms 118, 120 to move under the lower edges of flats 82, 84 and then into recesses 98, 100 (only recess 98 is shown in FIG. 4B) of lever retaining portion 50 as arms 118, 120 flex upwardly toward their original positions. As retaining wedges 162, 168 are biased into recesses 98, 100, retaining wedges 162, 168 inhibit rearward movement of CPA device 14 out of its locked position.

To move lever 14 back to its unlocked position, the user applies pressure to push ridge 135 of CPA device 14 to move CPA device 14 in a reverse direction, toward rear wall 22 of wire guide 10. Sufficient force causes cam surfaces 164, 170 of retaining wedges 162, 168 to move out of recesses 98, 100 and under the lower edges of flats 82, 84. This reverse movement is limited as retaining surface 152 of retaining wall 150 engages retaining surface 64 of retaining wedge 56 of CPA device receiving portion 48 when CPA device 14 reaches its first, unlocked position.

Next, the user applies downward pressure to cantilever latch 86 to permit retaining surface 182 of lever catch 178 to clear retaining surface 96 of cantilever latch 86. It should be understood that downward deflection of cantilever latch 86 is no longer prevented, as locking surface 160 of CPA device recess 158 is no longer positioned below cantilever latch 86. As the user applies downward pressure to cantilever latch 86, the user simultaneously rotates lever 14 counter-clockwise as viewed in the figures, out of its locked position.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A connector assembly, including:

a wire guide having a latch with a retaining surface;

a lever having a catch with a retaining surface, the lever being movable between an unlocked position and a locked position wherein the catch retaining surface engages the latch retaining surface to inhibit movement of the lever out of the locked position; and a CPA device having a locking surface, the CPA device being coupled to the wire guide for movement between a first position and a second position wherein the locking surface inhibits movement of the latch, thereby further inhibiting movement of the lever out of the locked position.

2. The connector assembly of claim 1, wherein the latch includes a cam surface and the catch includes a cam surface that engages the latch cam surface as the lever is moved into the locked position, thereby causing the latch to flex to permit movement of the latch into the locked position.

3. The connector assembly of claim 1, wherein the wire guide includes an opening for receiving a portion of the CPA device when the CPA device is moved into the second position.

4. The connector assembly of claim 1, wherein the CPA device includes a push ridge for use in moving the CPA device between the first position and the second position.

5. The connector assembly of claim 1, wherein the lever includes a pair of arms and is configured for pivotal movement between the locked position and the unlocked position about a first lug extending from one of the lever arms and a second lug extending from another of the lever arms.

6. The connector assembly of claim 1, wherein the wire guide includes a pair of channels for guiding movement of the CPA device between the first position and the second position.

7. The connector assembly of claim 6, wherein the CPA device includes a pair of rails that move within the pair of channels as the CPA device moves between the first position and the second position.

8. The connector assembly of claim 1, wherein the wire guide includes a retaining wedge having a retaining surface that engages a retaining surface formed on the CPA device to prevent the CPA device from moving in a first direction out of the first position.

9. The connector assembly of claim 8, wherein the wire guide retaining wedge is configured to flex to permit movement of the CPA device into the first position in a second direction that is opposite of the first direction.

10. The connector assembly of claim 9, wherein the CPA device includes a cam surface that engages a cam surface on the wire guide retaining wedge to cause the flexing of the wire guide retaining wedge as the CPA device is moved into the first position in the second direction.

11. The connector assembly of claim 3, wherein the CPA device includes a pair of arms that extend into the opening when the CPA device is in the second position.

12. The connector assembly of claim 11, wherein the CPA device arms each include a retaining wedge configured to inhibit movement of the arms into the opening when the CPA device is in the first position.

13. The connector assembly of claim 12, wherein the lever includes a pair of cams positioned to engage the CPA device retaining wedges as the lever is moved toward the locked position, thereby causing the arms to flex to permit movement of the arms into the opening.

14. The connector assembly of claim 12, wherein the wire guide includes a pair of recesses, the CPA device retaining wedges being biased into the recesses when the CPA device is in the second position, thereby inhibiting movement of the CPA device out of the second position.

15. The connector assembly of claim 1, wherein the lever includes a handle and a pair of arms that extend substantially perpendicularly from the handle.

16. The connector assembly of claim 15, wherein the catch extends from the handle.

17. The connector assembly of claim 15, wherein the lever is configured for pivotal movement between the locked position and the unlocked position about a first lug extending from one of the lever arms and a second lug extending from another of the lever arms.

18. The connector assembly of claim 17, further including a housing having one end for receiving the wire guide and another end configured to mate with a header.

19. The connector assembly of claim 18, wherein the housing includes a pair of recesses that respectively receive the lugs.

20. The connector assembly of claim 1, further including a housing having one end for receiving the wire guide and another end configured to mate with a header.

21. The connector assembly of claim 20, wherein the lever includes a pair of gears that engage a corresponding pair of grooves formed on the housing as the lever is moved from the unlocked position to the locked position, thereby drawing the housing toward the header.

22. A connector assembly, including:

a housing configured to mate with a header;

a wire guide mounted to the housing having a latch with a retaining surface;

a lever having a catch with a retaining surface, the lever being coupled to the housing for movement between an unlocked position and a locked position wherein the catch retaining surface engages the latch retaining surface to inhibit movement of the lever out of the locked position; and a CPA device having a locking surface, the CPA device being mounted to the wire guide for movement between a first position and a second position wherein the locking surface inhibits movement of the latch, thereby further inhibiting movement of the lever out of the locked position.

23. The connector assembly of claim 22, wherein the wire guide includes a retaining wedge having a retaining surface that engages a retaining surface formed on the CPA device to prevent the CPA device from moving in a first direction out of the first position.

24. The connector assembly of claim 22, wherein the latch includes a cam surface and the catch includes a cam surface that engages the latch cam surface as the lever is moved into the locked position, thereby causing the latch to flex to permit movement of the latch into the locked position.

25. The connector assembly of claim 22, wherein the CPA device includes a pair of arms that extend into an opening in the wire guide when the CPA device is in the second position.

26. The connector assembly of claim 25, wherein the CPA device arms each include a retaining wedge configured to inhibit movement of the arms into the opening when the CPA device is in the first position.

27. The connector assembly of claim 26, wherein the lever includes a pair of cams positioned to engage the CPA device retaining wedges as the lever is moved toward the locked position, thereby causing the arms to flex to permit movement of the arms into the opening.

28. The connector assembly of claim 26, wherein the wire guide includes a pair of recesses, the CPA device retaining wedges being biased into the recesses when the CPA device is in the second position, thereby inhibiting movement of the CPA device out of the second position.

29. A connector assembly, including:

means for coupling to a header;

means mounted to the coupling means for guiding wires into the coupling means;

means for preventing removal of the guide means, the preventing means being movable between a locked position and an unlocked position and including a first means for retaining the preventing means in the locked position by engaging a second means of the guiding means for retaining the preventing means in the locked position when the preventing means is moved into the locked position; and means movable between a first position and a second position for assuring the position of the preventing means when the preventing means is in the locked position, the position assuring means including means for engaging the second retaining means when the position assuring means is in the second position, thereby inhibiting movement of the second retaining means.

* * * * *